US008833326B2

(12) United States Patent
Koyama

(10) Patent No.: US 8,833,326 B2
(45) Date of Patent: Sep. 16, 2014

(54) AIR CLEANER DEVICE FOR INTERNAL COMBUSTION ENGINE

(71) Applicant: Honda Motor Co., Ltd., Tokyo (JP)

(72) Inventor: Shinya Koyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/954,107

(22) Filed: Jul. 30, 2013

(65) Prior Publication Data

US 2014/0041615 A1 Feb. 13, 2014

(30) Foreign Application Priority Data

Aug. 10, 2012 (JP) ..... 2012-178484

(51) Int. Cl.
*F02M 35/10* (2006.01)
*F02M 35/024* (2006.01)

(52) U.S. Cl.
CPC ..... *F02M 35/024* (2013.01)
USPC ..... 123/184.57; 123/198 E

(58) Field of Classification Search
CPC . F02M 35/14; F02M 35/162; F02M 35/1255; F02M 35/1266; F02M 35/1261; F02M 35/1288; F02M 35/0201; F02M 35/0202; F02M 35/024; F02M 35/02; B01D 46/00
USPC ..... 123/184.57, 198 E; 55/385.3; 96/380, 96/382, 386; 181/229
See application file for complete search history.

(56) References Cited

U.S. PATENT DOCUMENTS

| | | | | |
|---|---|---|---|---|
| 6,251,151 | B1 * | 6/2001 | Kobayashi et al. | 55/309 |
| 6,530,984 | B2 * | 3/2003 | Stuart | 96/380 |
| 2003/0126841 | A1 * | 7/2003 | Pettipiece | 55/385.3 |
| 2007/0149105 | A1 * | 6/2007 | Nakagome et al. | 454/136 |

FOREIGN PATENT DOCUMENTS

JP 10-311259 A 11/1998

* cited by examiner

*Primary Examiner* — Hung Q Nguyen
(74) *Attorney, Agent, or Firm* — Squire Patton Boggs (US) LLP

(57) ABSTRACT

A bottom inner wall of an air cleaner case is provided with a first and second bulging parts and roughly U-shaped in section which have projected surfaces on the inside of the air cleaner case and recessed surfaces on the outside of the air cleaner case. First and second resonators are formed by a structure wherein first and second compartments continuously surrounded by the first and second bulging parts as well as a pair of side inner walls, the bottom inner wall and a partition wall of the air cleaner case are closed with first and second lids provided with communication holes.

18 Claims, 6 Drawing Sheets

AIR CLEANER DEVICE FOR INTERNAL COMBUSTION ENGINE

BACKGROUND

1. Field

The present invention relates to an air cleaner device for an internal combustion engine, particularly to an air cleaner device for an internal combustion engine that has a resonator.

2. Description of the Related Art

Conventionally, in an intake system for an engine (internal combustion engine) of an automobile or a motorcycle or the like, an air cleaner device may incorporate a resonator for reducing intake noise. As this kind of resonator, there has been known a configuration in which lids having through-holes are provided on the inside of a case main body and a cover part of an air cleaner case so that the space between the lid and an inner wall of the case main body and the space between the lid and an inner wall of the cover part are made to be resonators (see, for example, Patent Document 1 (Japanese Patent Laid-Open No. Hei 10-311259 (FIGS. 5 and 6)).

In Patent Document 1, it is possible to restrain mutual layout-basis interference of the plurality of resonators while securing the internal volumes of the resonators. In this case, however, the space in which to lay out the plurality of resonators while avoiding a cleaning filter, within the limited internal volume of the air cleaner case, is restricted. Thus, the degree of freedom in layout of the resonators has been low.

Furthermore, in Patent Document 1, it is disclosed that the plurality of resonators are configured independently from the air cleaner case by use of other members. In this case, a soundproof seal structure for preventing leakage of noise has had to be provided at the joint part between the air cleaner case and the resonator. Thus, there has been a problem that the air cleaner device is complicated in structure and that the number of component parts and the manufacturing cost may be increased.

SUMMARY

The present invention has been made in consideration of the above-mentioned circumstances. Accordingly, it is an object of the present invention to provide an air cleaner device for an internal combustion engine such that the degree of freedom in layout of a resonator can be enhanced without increasing the number of component parts and the manufacturing cost.

In order to attain the above object, according to an embodiment of the invention, there is provided an air cleaner device for an internal combustion engine. The device and include a cleaning filter for cleaning intake air supplied to the internal combustion engine, and a resonator adapted to reduce intake noise due to the intake air. An air cleaner case is formed therein with a chamber, the cleaning filter and the resonator being disposed in the chamber. The chamber is defined by inner walls of the air cleaner case, and at least one of the inner walls is provided with a bulging part roughly U-shaped in section. The bulging part has a projected surface on the inside of the air cleaner case and a recessed surface on the outside of the air cleaner case, and is so formed as to be connected to mutually opposed ones of the inner walls. The resonator is formed by a structure in which a compartment continuously surrounded by the bulging part and the inner walls is closed with a lid provided with a communication hole.

In another embodiment, a plurality of the bulging parts are provided, and a part of the bulging parts is so formed as to be connected to the inner wall and the other bulging part which are opposed to each other.

In another embodiment, a vehicle to which the air cleaner device is mounted has a cross member interconnecting a pair of left and right frames in a vehicle width direction, a plurality of the resonators are provided, the plurality of the resonators are juxtaposed along the cross member, one of the plurality of the bulging parts is formed in a direction along the cross member, and the cross member is disposed in an inside space of the recessed surface of the bulging part.

In another embodiment, a throttle body having a throttle valve is connected to the internal combustion engine. A throttle wire adapted to control the opening of the throttle valve is connected to the throttle valve. One of the plurality of the bulging parts is formed along a direction in which the throttle wire extends. A plurality of the resonators are formed, with the plurality of the resonators being juxtaposed along a direction substantially orthogonal to the direction in which the throttle wire extends. The throttle wire is disposed in an inside space of the recessed surface of the bulging part.

In another embodiment, the lid is mounted on an extension part integrally extended from vicinity of a peak of the projected surface of the bulging part.

In another embodiment, the communication hole of the lid is provided with a hollow cylindrical part, and the hollow cylindrical part extends from a back surface of the lid toward the inside of the resonator.

In another embodiment, an air duct adapted to introduce the intake air into the chamber is provided, and the air duct is so disposed that its flow path direction is substantially orthogonal to an axial direction of the hollow cylindrical part in side view of the vehicle.

In another embodiment, a plurality of the lids are provided, and the hollow cylindrical parts of the plurality of the lids are arranged respectively on both outer sides of a downstream end of the air duct, with reference to the flow path direction of the air duct.

In other embodiments, the plurality of the lids are integrally connected by a connecting part, and the connecting part is fixed to the air cleaner case.

According to certain embodiments, the chamber is defined by the inner walls of the air cleaner case. In addition, at least one of the inner walls is provided with the bulging part roughly U-shaped in section, the bulging part having the projected surface on the inside of the air cleaner case and the recessed surface on the outside of the air cleaner case. Besides, the bulging part is so formed as to be connected to mutually opposed ones of the inner walls. Further, the resonator is formed by a structure in which the compartment continuously surrounded by the bulging part and the inner walls is closed with the lid provided with the communication hole. Therefore, the degree of freedom in layout of the resonator can be enhanced without increasing the number of component parts and the manufacturing cost. Besides, since it is unnecessary to provide other bulging part to be used exclusively for the resonator, the internal volume of the chamber of the air cleaner case can be prevented from being reduced.

In embodiments where a plurality of the bulging parts are provided, a part of the bulging parts is so formed as to be connected to the inner wall and the other bulging part which are opposed to each other. Therefore, there would be little influence of the positions of the inner walls of the air cleaner case, and the resonator can be provided comparatively freely.

In embodiments where a plurality of the resonators are provided, the plurality of resonators are juxtaposed along the cross member. In addition, one of the plurality of bulging parts is formed in the direction along the cross member, and the cross member is disposed in the inside space of the recessed surface of the bulging part. Therefore, compartments of the plurality of resonators can be configured by utilizing the bulging part in which the cross member is passed, while avoiding physical interference between the cross member and the air cleaner case.

In certain embodiments, one of the plurality of bulging parts is formed along the direction in which the throttle wire extends, and the plurality of resonators are juxtaposed along the direction substantially orthogonal to the direction in which the throttle wire extends. In addition, the throttle wire is disposed in the inside space of the recessed surface of the bulging part. Therefore, the plurality of resonators can be laid out by utilizing the bulging part in which to pass the throttle wire, while obviating physical interference between the throttle wire and the air cleaner case. This makes it possible to suppress the number of bulging parts to be disposed.

According to certain embodiments, the lid is mounted on the extension part integrally extended from the vicinity of the peak of the projected surface of the bulging part. Therefore, the internal volume of the resonator can be easily controlled by changing the height size of the extension part.

According to certain embodiments, the communication hole of the lid is provided with the hollow cylindrical part, and the hollow cylindrical part extends from the back surface of the lid toward the inside of the resonator. Therefore, a muffling effect on intake noise can be easily controlled by changing the height size of the hollow cylindrical part.

According to certain embodiments, the air duct adapted to introduce the intake air into the chamber is provided, and the air duct is so disposed that its flow path direction is substantially orthogonal to the axial direction of the hollow cylindrical part in side view of the vehicle. This ensures that even if dust or water is mixed into the intake air introduced via the air duct, the dust or water can be restrained from entering into the resonator by passing through the hollow cylindrical part.

According to certain embodiments, the hollow cylindrical parts of the plurality of lids are arranged respectively on both outer sides of the downstream end of the air duct, with reference to the flow path direction of the air duct. Therefore, even if dust or water is mixed into the intake air introduced through the air duct, the dust or water can be further restrained from entering into the resonator by passing through the hollow cylindrical part.

According to certain embodiments, the plurality of lids are integrally connected by the connecting part, and the connecting part is fixed to the air cleaner case. Therefore, the number of attaching positions can be reduced while reducing the number of component parts. Consequently, assembleability of the air cleaner device can be enhanced.

DETAILED DESCRIPTION

Figure 1:
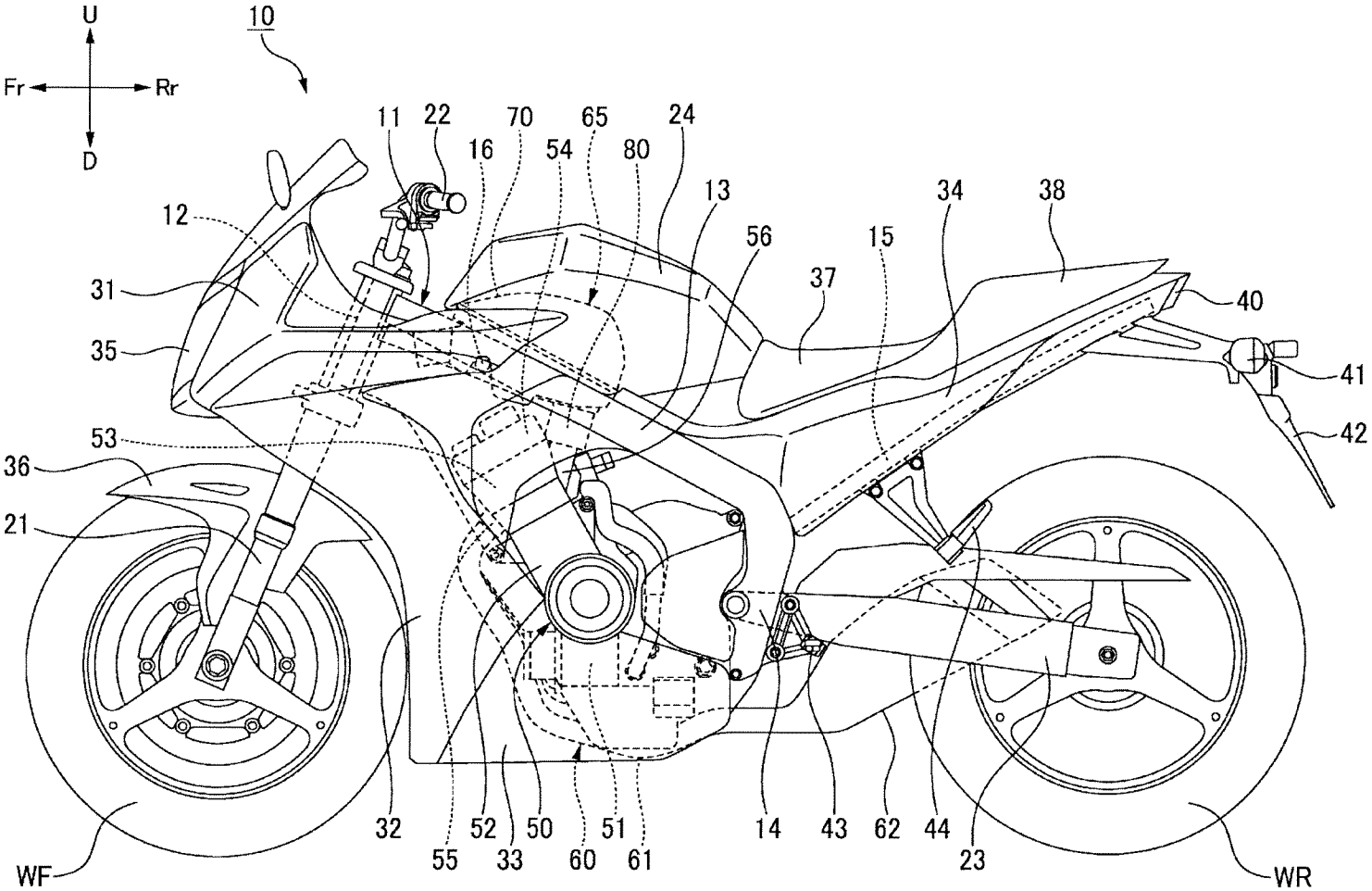
FIG. 1 is a left side view illustrating a motorcycle on which an embodiment of an air cleaner device for an internal combustion engine according to the present invention is mounted.

Now, an embodiment of the air cleaner device for an internal combustion engine according to the present invention will be described in detail below, referring to the drawings. Incidentally, the drawings are to be viewed according to the orientation of reference symbols. In the following description, the forward, rearward, leftward, rightward, upward and downward directions are those as viewed from the driver. In the drawings, the front side of the vehicle is indicated as Fr, the rear side as Rr, the left side as L, the right side as R, the upper side as U, and the lower (downward) side as D.

Figure 3:
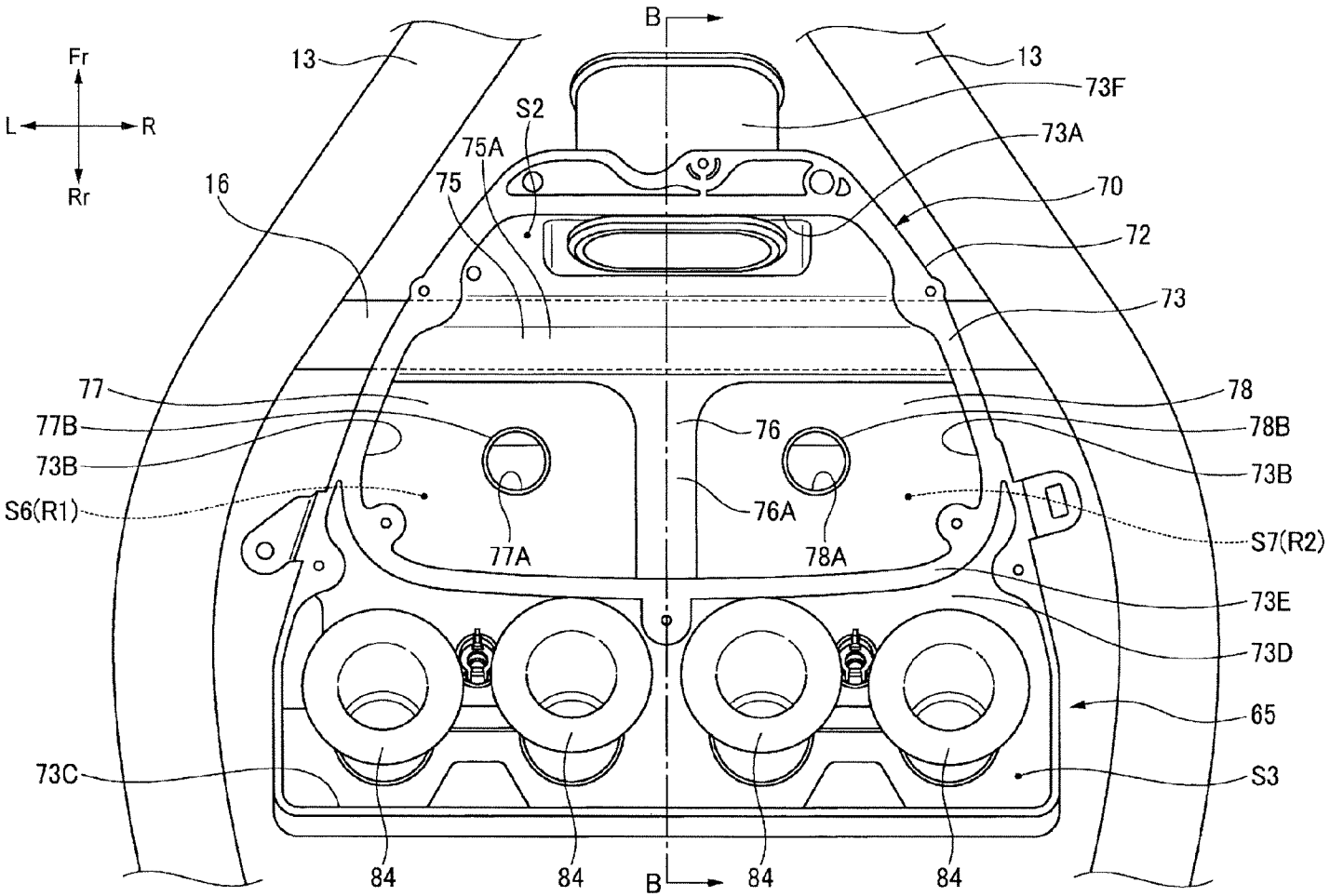
FIG. 3 is a top plan view of the state wherein a cover part of an air cleaner case shown in FIG. 2 is removed.

As shown in FIG. 1, a motorcycle 10 in the present embodiment has a body frame 11 which includes a head pipe 12 provided at the front end thereof. A pair of left and right main frames (a pair of left and right frames) 13 extend rearward and downward from the head pipe 12. A pair of left and right pivot plates 14 are connected to rear end portions of the pair of left and right main frames 13 and extend downward. A pair of left and right seat frames 15 are connected to upper portions of the pair of left and right pivot plates 14 and extend rearward and upward. An engine such as internal combustion engine 50 is mounted to the main frames 13 and the pivot plates 14. In addition, as shown in FIG. 3, the body frame 11 has a cross frame (cross member) 16 interconnecting the pair of left and right main frames 13 in the vehicle width direction.

The motorcycle 10 can include a front fork 21 steerably supported on the head pipe 12. A front wheel WF is rotatably supported on a lower end portion of the front fork 21. A steering handle 22 is attached to an upper end portion of the front fork 21, and a swing arm swingably supported on the pivot plates 14. A rear wheel WR is rotatably supported on a rear end portion of the swing arm 23, and a fuel tank 24 is disposed on the upper side of the engine 50.

In FIG. 1, reference sign 31 denotes a front cowl, 32 a front side cowl, 33 an under cowl, 34 a rear cowl, 35 a headlight, 36 a front fender, 37 a driver's seat, 38 a passenger's seat, 40 a taillight, 41 a rear turn signal lamp, 42 a rear fender, 43 a main step, and 44 denotes a pillion step.

The engine 50 is, this example, a parallel four-cylinder engine. As shown in FIG. 1, an outer hull of the engine is composed mainly of a crankcase 51, a cylinder block 52 attached to a front upper end portion of the crankcase 51, a cylinder head 53 attached to an upper end portion of the cylinder block 52, and a cylinder head cover 54 which covers an upper opening of the cylinder head 53. The engine 50 in the present embodiment is of a front-exhaust rear-intake type. Therefore, four exhaust ports 55 are provided at a front surface of the cylinder head 53, and four intake ports 56 are provided at a rear surface of the cylinder head 53. An exhaust system 60 is connected to the exhaust ports 55 of the engine 50, and an intake system 65 is connected to the intake ports 56.

The exhaust system 60 includes an exhaust pipe which is connected to the exhaust ports 55 of the engine 50 and extends toward the vehicle rear side, and a muffler 62 connected to the downstream end of the exhaust pipe 61.

Figure 2:
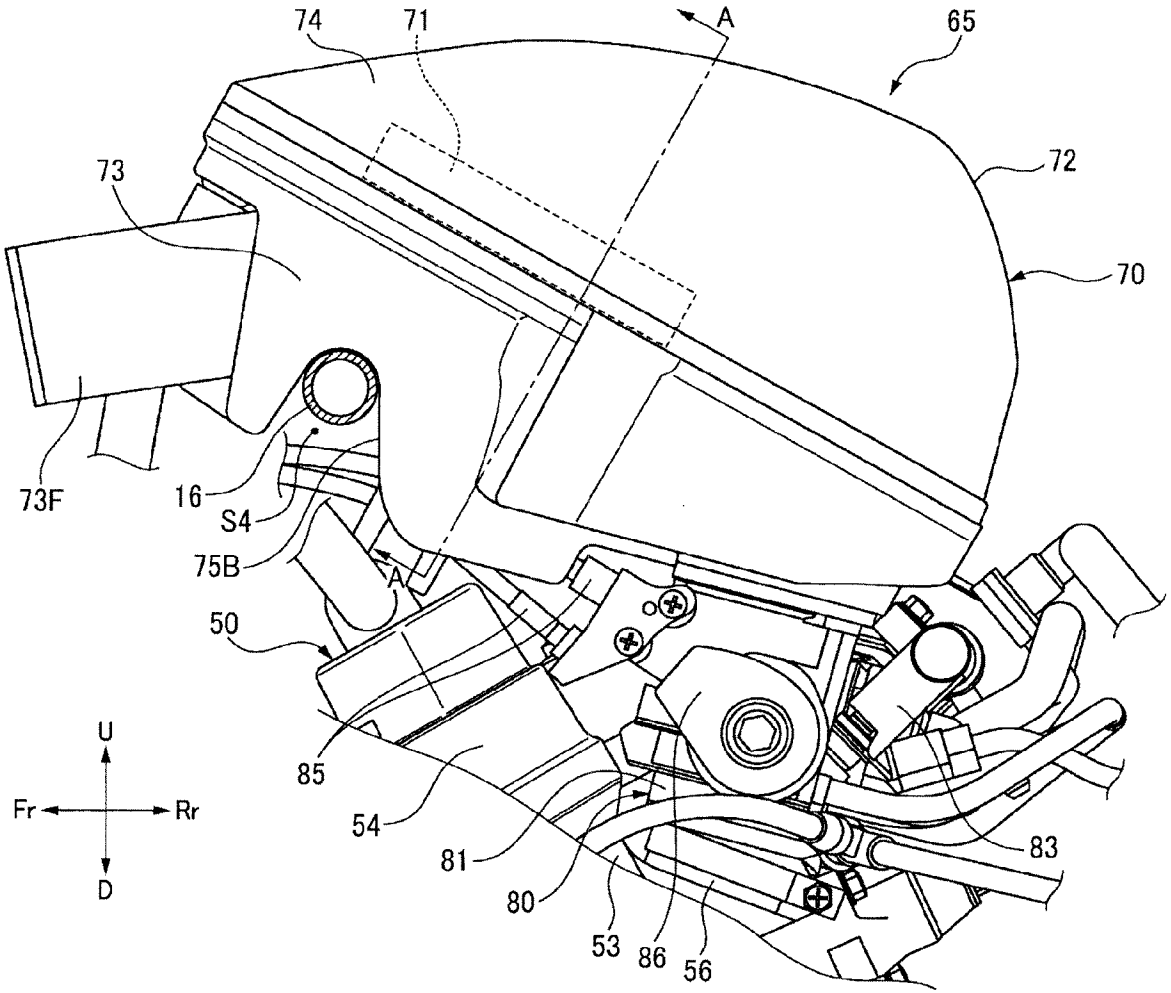
FIG. 2 is a left side view of the surroundings of the air cleaner device shown in FIG. 1.

As shown in FIG. 2, the intake system 65 is connected to the four intake ports 56 of the engine 50, and includes an air cleaner device 70 connected to an upstream-side end portion of an intake passage, and a throttle bodies 80 constituting a part of the intake passage.

Figure 5:
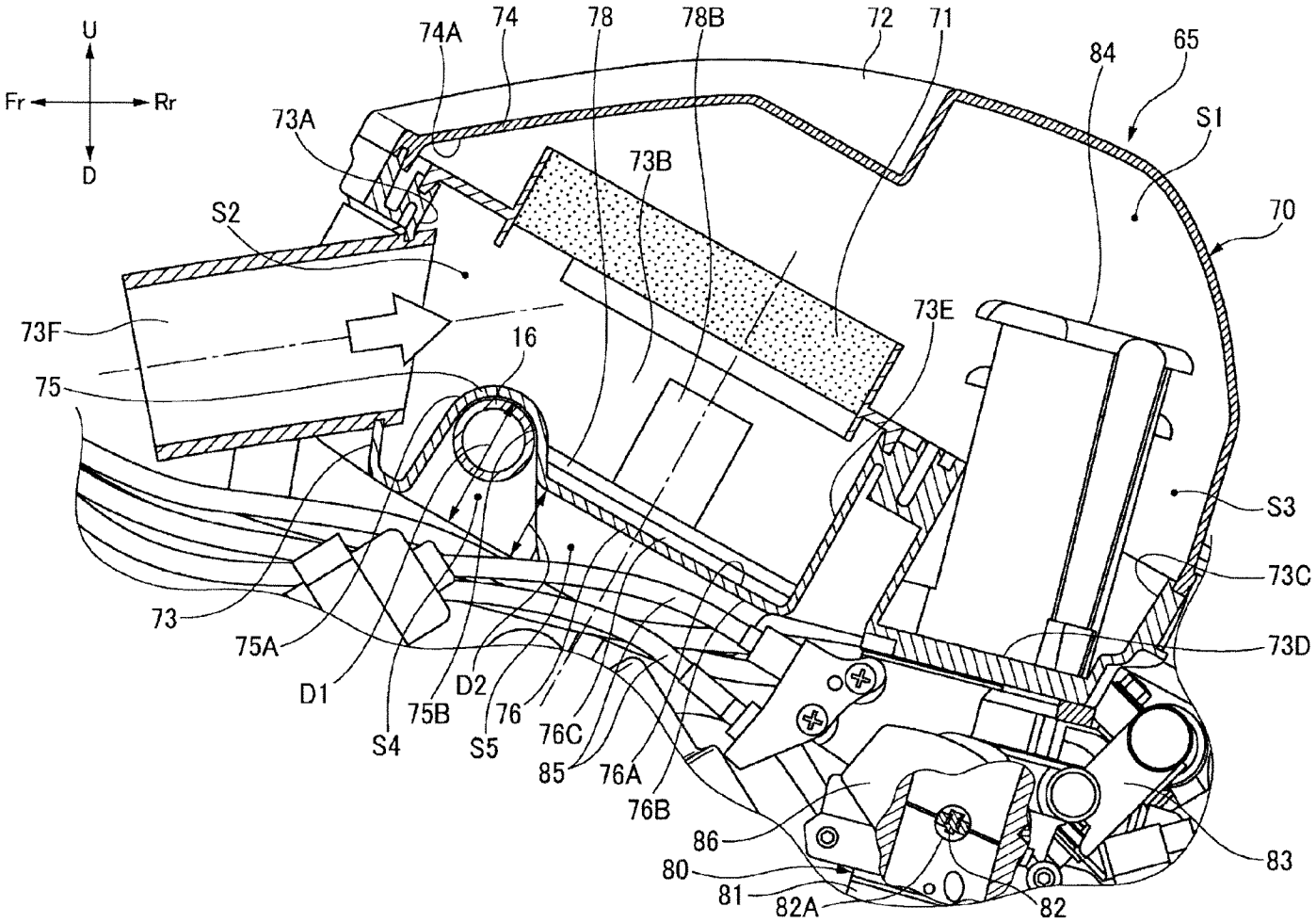
FIG. 5 is a sectional view, corresponding to line B-B of FIG. 3, of the air cleaner device shown in FIG. 2.

As shown in FIGS. 2, 3 and 5, the throttle bodies 80 are disposed in the number of four correspondingly to the cylinders of the engine 50. The throttle bodies 80 are each connected to the intake port 56 on the downstream side, and to the air cleaner device on the upstream side. As shown in FIG. 5, the throttle body 80 includes a throttle body main body 81 having the intake passage, a throttle valve 82 disposed inside the throttle body main body 81 so as to open and close the intake passage, an injector 83 for injecting a fuel into the intake passage, and an air funnel 84 attached to the upstream end of the throttle body main body 81.

The throttle valve 82 is connected to a rotating shaft 82A. A tip portion of the rotating shaft 82A protrudes from the throttle body main body 81 to the exterior, and a plate-shaped turning body 86 is attached to the tip portion. A pair of throttle wires 85, 85 which are disposed in the vehicle longitudinal direction and by which the opening of the throttle valve 82 is controlled, are connected to the turning body 86.

As shown in FIGS. 2 to 5, the air cleaner device 70 includes a cleaning filter 71 which is disposed just above the cylinder head cover 54 of the engine 50 and cleans intake air supplied to the engine 50. First and second resonators R1 and R2 are provided, for reducing intake noise due to the intake air. An air cleaner case 72 is formed therein with a chamber S1 in which the cleaning filter 71 and the first and second resonators R1 and R2 are disposed.

The air cleaner case 72 is formed in an upper-lower split structure; specifically, the air cleaner case includes a bottomed, roughly bowl-shaped case main body 73 mounted to an upstream-side end portion of the throttle body 80, and a dome-shaped cover part 74 closing the case main body 73.

Figure 4:
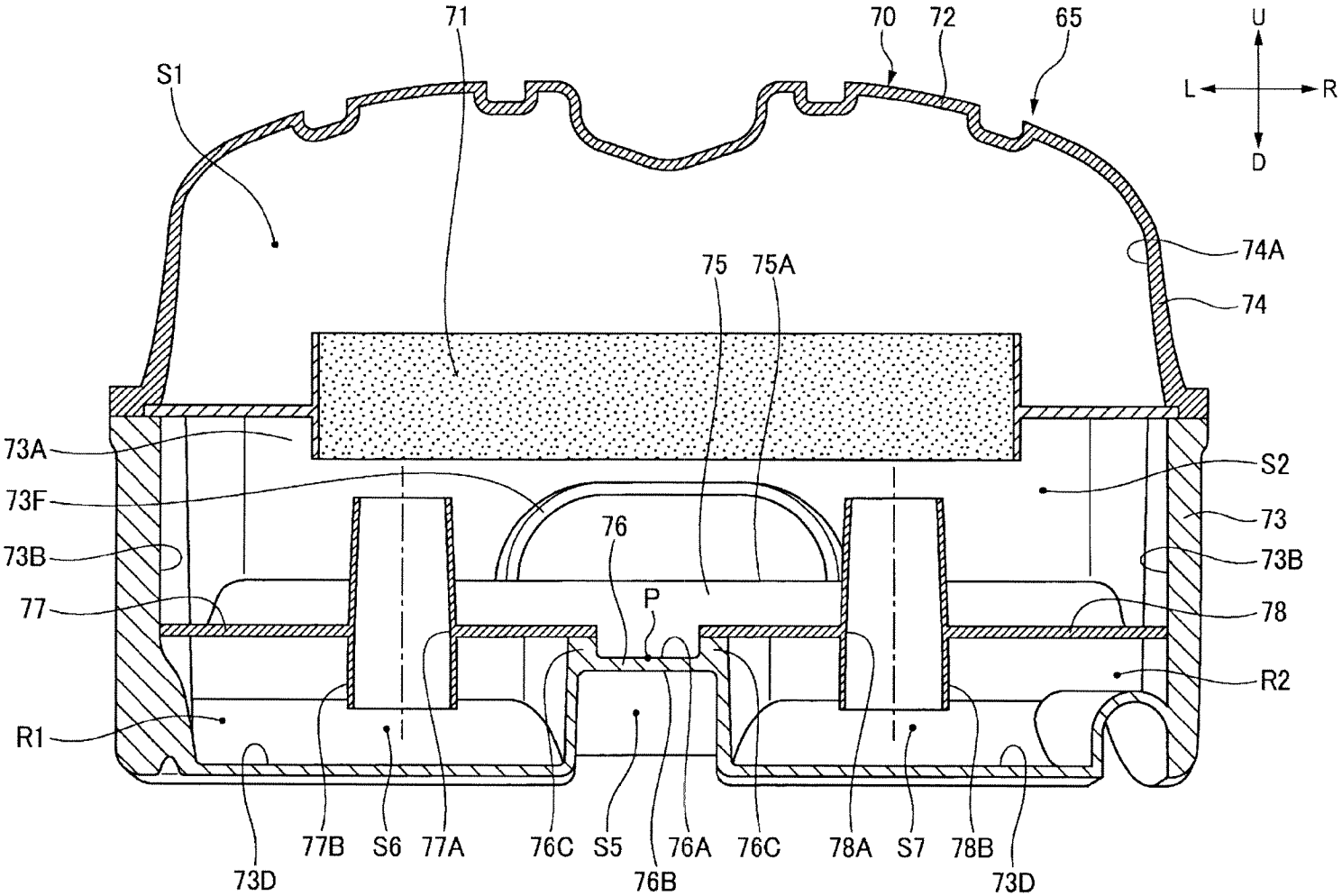
FIG. 4 is a sectional view of the air cleaner device taken along line A-A of FIG. 2.

As shown in FIGS. 3 to 5, the case main body 73 is formed in a roughly trapezoidal shape in top plan view. Specifically, the case main body 73 includes a front inner wall 73A, and a pair of side inner walls 73B, 73B which extended toward the vehicle rear side and obliquely outwards from both side edges of the front inner wall 73A and which are opposed to each other. A rear inner wall 73C interconnects rear end portions of the pair of side inner walls 73B, 73B. A bottom inner wall 73D which interconnects the lower end edges of the front inner wall 73A, the pair of side inner walls 73B, 73B and the rear inner wall 73C. Furthermore, the case main body 73 is provided, as its inner wall, with a partition wall (inner wall) 73E by which the inside space of the case main body 73 is partitioned into front and rear regions. As a result, a front-side compartment S2 and a rear-side compartment S3 are formed.

An inside surface of the cover part 74 is also made to be an inner wall 74A. As shown in FIGS. 4 and 5, in the state where the case main body 73 and the cover part 74 are coupled to each other, the chamber S1 is defined by the inner walls 73A, 73B, 73C, and 73D of the case main body 73 and the inner wall 74A of the cover part 74.

An air duct 73F serving as an outside air introducing passage is mounted to a front surface portion of the case main body 73 in such a manner as to be located on the vehicle center line. The air duct 73F communicates with the front-side compartment S2.

The cleaning filter 71 is so disposed as to cover the upper side of the front-side compartment S2 of the case main body 73. This ensures that intake air taken in through the air duct 73F first passes through the front-side compartment S2 of the case main body 73, and further passes through the cleaning filter 76, before being guided into the inside space of the cover part 74 and into the rear-side compartment S3 of the case main body 73. In other words, the front-side compartment S2 of the case main body 73 is made to be a dirty room, whereas the inside space of the cover part 74 and the rear-side compartment S3 of the case main body 73 are made to be clean rooms.

As shown in FIGS. 3 to 5, the bottom inner wall 73D of the case main body 73 is formed with a first bulging part 75 and a second bulging part 76 which are both roughly U-shaped in section. The first bulging part 75 has a projected surface 75A on the inside of the air cleaner case 72, and a recessed surface 75B on the outside of the air cleaner case 72. The second bulging part 76 has a projected surface 76A on the inside of the air cleaner case 72, and a recessed surface 76B on the outside of the air cleaner case 72.

As shown in FIGS. 3 and 4, the first bulging part 75 is so formed as to be connected to the pair of side inner walls 73B, 73B which are opposed to each other. In other words, the first bulging part 75 extends over the bottom inner wall 73D inside the case main body 73 in a direction along the vehicle width direction and along the cross frame 16. Therefore, as shown in FIGS. 2 and 5, the inside space S4 of the recessed surface 75B of the first bulging part 75 is formed in a tunnel-like shape along the vehicle width direction, ranging over the whole part of the case main body 73. In the state wherein the air cleaner device 70 is mounted to the motorcycle 10, the cross frame 16 is disposed in the inside space S4 of the recessed surface 75B of the first bulging part 75.

As shown in FIGS. 3 to 5, the second bulging part 76 is so formed as to be connected to both the partition wall 73E and the first bulging part 75 which are opposed to each other. Specifically, the second bulging part 76 is extended over the bottom inner wall 73D in a direction along the vehicle longitudinal direction and along the throttle wires 85 of the throttle body 80, in such a manner as to interconnect the partition wall 73E and the first bulging part 75. Therefore, as shown in FIGS. 4 and 5, the inside space S5 of the recessed surface 76B of the second bulging part 76 is formed in a tunnel-like shape along the vehicle longitudinal direction, ranging over a part of the case main body 73. In the state wherein the air cleaner device 70 is mounted to the motorcycle 10, the throttle wires 85 are disposed in the inside space S5 of the recessed surface 76B of the second bulging part 76.

As shown in FIG. 4, a pair of extension parts 76C, 76C are integrally formed to extend from the vicinity of the peak P of the projected surface 76A of the second bulging part 76. The pair of extension parts 76C, 76C are arranged in parallel to each other, with the peak P located therebetween in the vehicle width direction.

As shown in FIG. 5, the depth size D1 of the recessed surface 75B of the first bulging part 75 is set to be greater than the depth size D2 of the recessed surface 76B of the second bulging part 76. Therefore, the cross frame 16 and the throttle wires 85 disposed respectively in the inside spaces S4 and S5 of the first and second bulging parts 75 and 76 can be positioned appropriately, so that physical interference therebetween can be restrained.

In addition, as shown in FIGS. 3 and 4, two spaces are formed which are continuously surrounded by parts of the projected surfaces 75A and 76A of the first and second bulging parts 75 and 76, the pair of inside inner walls 73B, 73B, the partition wall 73E, and the bottom inner wall 73D. These spaces are made to be first and second compartments S6 and S7. The first and second compartments S6 and S7 are closed with first and second lids 77 and 78 provided with communication holes 77A and 78A, respectively. As a result of this, the first and second resonators R1 and R2 are formed.

As above-mentioned, the first bulging part 75 is formed along the cross frame 16, whereas the second bulging part 76 is formed along the direction in which the throttle wires 85 of the throttle body 80 extend. As shown in FIGS. 3 and 4, therefore, the first and second resonators R1 and R2 are juxtaposed along the cross frame 16. The direction along the cross frame 16 is substantially orthogonal to the direction in which the throttle wires 85 extend. Therefore, it can also be said that the first and second resonators R1 and R2 are juxtaposed along the direction substantially orthogonal to the direction in which the throttle wires 85 extend.

The first and second lids 77 and 78 are composed of roughly rectangular flat plates. As shown in FIGS. 3 to 5, the communication holes 77A and 78A of the first and second lids 77 and 78 are formed at roughly central portions of the first and second lids 77 and 78, respectively. In addition, the first and second lids 77 and 78 are mounted respectively on the pair of extension parts 76C, 76C of the second bulging part 76. Incidentally, the first and second lids 77 and 78 are fixed to the case main body 73 of the air cleaner case 72 by, for example, ultrasonic welding along their peripheral edges.

In addition, hollow cylindrical parts 77B and 78B are provided at the communication holes 77A and 78A of the first and second lids 77 and 78, respectively. The hollow cylindrical parts 77B and 78B extend from the back surfaces of the first and second lids 77 and 78 toward the inside of the first and second resonators R1 and R2 and also extend from the faces of the first and second lids 77 and 78 toward the outside of the first and second resonators R1 and R2.

Besides, as shown in FIGS. 3 and 5, the air duct 73F is so disposed that the intake air flow path direction thereof is substantially orthogonal to the axial directions of the hollow cylindrical parts 77B and 78B of the first and second lids 77 and 78, in side view of the vehicle.

As shown in FIGS. 3 and 4, the hollow cylindrical parts 77B and 78B of the first and second lids 77 and 78 are disposed respectively on the vehicle-width-directionally opposite sides of the downstream end of the air duct 73F, with reference to the flow path direction of the air duct 73F.

As has been described above, according to the air cleaner device 70 of the present embodiment, the bottom inner wall 73D of the air cleaner case 72 is provided with the first and second bulging parts 75 and 76 roughly U-shaped in section which have the projected surfaces 75A and 76A on the inside of the air cleaner case 72 and have the recessed surfaces 75B and 76B on the outside of the air cleaner case 72. The first bulging part 75 is so formed as to be connected to the pair of side inner walls 73B, 73B opposed to each other, whereas the second bulging part 76 is so formed as to be connected to the partition wall 73E and the first bulging part 75 which are opposed to each other. The first and second resonators R1 and R2 are formed by a structure wherein the first and second compartments S6 and S7 continuously surrounded by the first and second bulging parts 75 and 76, the pair of side inner walls 73B, 73B, the bottom inner wall 73D, and the partition wall 73E are closed with the first and second lids 77 and 78 provided with the communication holes 77A and 78A. Therefore, the degree of freedom in layout of the first and second resonators R1 and R2 can be enhanced without increasing the number of component parts and the manufacturing cost. Besides, since it is unnecessary to provide other bulging parts to be used exclusively for the resonators, it is possible to prevent the internal volume of the chamber S1 of the air cleaner case 72 from being reduced.

According to the air cleaner device 70 of the present embodiment, the second bulging part 76 is so formed as to be connected to the partition wall 73E and the first bulging part 75 which are opposed to each other. Therefore, there would be little influence of the positions of the inner walls 73A, 73B, 73C, 73D, and 73E of the air cleaner case 72, and the first and second resonators R1 and R2 can be provided comparatively freely.

According to the air cleaner device 70 of the present embodiment, the first and second resonators R1 and R2 are juxtaposed along the cross frame 16. In addition, the first bulging part 75 is formed in the direction along the cross frame 16, and the cross frame is disposed in the inside space S4 of the recessed surface 75B of the first bulging part 75. Therefore, the compartments S6 and S7 of the first and second resonators R1 and R2 can be configured by utilizing the first bulging part 75 in which the cross frame 16 is passed, while avoiding physical interference between the cross frame 16 and the air cleaner case 72.

According to the air cleaner device 70 of the present embodiment, the second bulging part 76 is formed along the direction in which the throttle wires 85 extend. Besides, the first and second resonators R1 and R2 are juxtaposed along the direction substantially orthogonal to the direction in which the throttle wires 85 extend, and the throttle wires 85 are disposed in the inside space S5 of the recessed surface 76B of the second bulging part 76. Therefore, the first and second resonators R1 and R2 can be laid out by utilizing the second bulging part 76 in which the throttle wires 85 are passed, while avoiding physical interference between the throttle wires 85 and the air cleaner case 72. Consequently, the number of the bulging parts 75 and 76 to be disposed can be suppressed.

According to the air cleaner device 70 of the present embodiment, the first and second lids 77 and 78 are mounted on the pair of extension parts 76C, 76C which are integrally extended from the vicinity of the peak of the projected surface 76A of the second bulging part 76. Therefore, the internal volume(s) of the first and second resonators R1 and R2 can be easily controlled by changing the height size(s) of the pair of extension parts 76C, 76C.

The hollow cylindrical parts 77B and 78B can be provided at the communication holes 77A and 78A of the first and second lids 77 and 78 extend from the back surfaces of the first and second lids 77 and 78 toward the inside of the first and second resonators R1 and R2, respectively. Therefore, the muffling effect on the intake noise can be easily controlled by changing the height size of the hollow cylindrical parts 77B and 78B.

According to certain embodiments, the air duct 73F of the air cleaner case 72 is so laid out that the flow path direction thereof is substantially orthogonal to the axial direction of the hollow cylindrical parts 77B and 78B in side view of the vehicle. It ensures that even if dust or water is mixed into the intake air introduced via the air duct 73F, the dust or water can be restrained from entering into the first and second resonators R1 and R2 by passing through the hollow cylindrical parts 77B and 78B.

According to the air cleaner device 70 of the present embodiment, the hollow cylindrical parts 77B and 78B of the first and second lids 77 and 78 are laid out respectively on vehicle-width-directionally opposite sides of the downstream end of the air duct 73F, with reference to the flow path direction of the air duct 73F. This ensures that even if dust or water is mixed into the intake air introduced through the air duct 73F, the dust or water can be further restrained from entering into the first and second resonators R1 and R2 by passing through the hollow cylindrical parts 77B and 78B.

Figure 6:
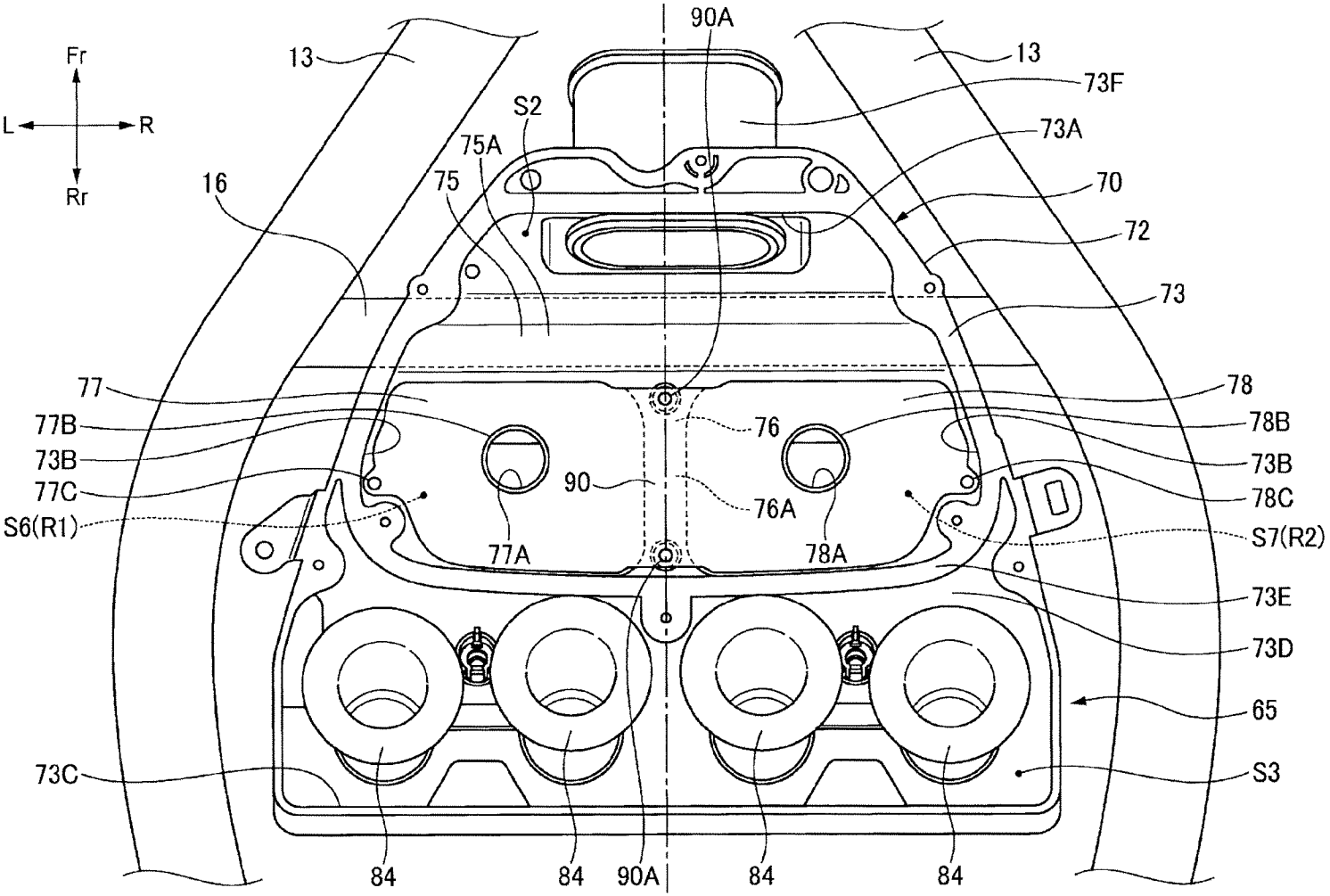
FIG. 6 is a top plan view, corresponding to FIG. 3, for illustrating a modification of the embodiment of the air cleaner device for the internal combustion engine according to certain embodiments of the present invention.

As a modification of the present embodiment, the first and second lids 77 and 78 may be integrally interconnected by a connecting part 90, as shown in FIG. 6. In the present modification, fixing parts 90A, 90A at two portions (front and rear portions) of the connecting part 90, a fixing part 77C at a left end portion of the first lid 77, and a fixing part 78C at a right end portion of the second lid 78 are joined to the case main body 73 of the air cleaner case 72 by, for example, ultrasonic welding. This results in that the united first and second lids 77 and 78 and the connecting part 90 are fixed to the case main body 73.

As above-mentioned, according to the present modification, the first and second lids 77 and 78 are integrally connected by the connecting part 90, and the connecting part 90 is fixed to the air cleaner case 72. Therefore, the number of attaching positions can be reduced while reducing the number of component parts, and assembleability of the air cleaner device 70 can be thereby enhanced.

The present invention is not to be restricted to those which are shown in the above-described embodiments, and appropriate modifications are possible without departure from the gist of the invention.

DESCRIPTION OF REFERENCE SYMBOLS

10 Motorcycle
11 Body frame
13 Main frame (Pair of left and right frames)
16 Cross frame (Cross member)
50 Engine (Internal combustion engine)
65 Intake system
70 Air cleaner device
71 Cleaning filter
72 Air cleaner case
73 Case main body
73A Front inner wall (Inner wall)
73B Side inner wall (Inner wall)
73C Rear inner wall (Inner wall)
73D Bottom inner wall (Inner wall)
73E Partition wall (Inner wall)
73F Air duct
74 Cover part
74A Inner wall
75 First bulging part (Bulging part)
75A Projected surface
75B Recessed surface
76 Second bulging part (Bulging part)
76A Projected surface
76B Recessed surface
76C Extension part
77 First lid (Lid)
77A Communication hole
77B Hollow cylindrical part
78 Second lid (Lid)
78A Communication hole
78B Hollow cylindrical part
80 Throttle body
82 Throttle valve
85 Throttle wire
90 Connecting part
P Peak
R1 First resonator (Resonator)
R2 Second resonator (Resonator)
S1 Chamber
S4 Inside space of recessed surface of first bulging part
S5 Inside space of recessed surface of second bulging part
S6 First compartment (Compartment)
S7 Second compartment (Compartment)

The invention claimed is:

1. An air cleaner device for an internal combustion engine, said air cleaner device comprising:

a cleaning filter configured to clean intake air supplied to the internal combustion engine;

a resonator configured to reduce intake noise due to the intake air; and an air cleaner case formed therein with a chamber, the cleaning filter and the resonator being disposed in the chamber, wherein the chamber is defined by inner walls of the air cleaner case, at least one of the inner walls is provided with a bulging part roughly U-shaped in section, the bulging part having a projected surface on the inside of the air cleaner case and a recessed surface on the outside of the air cleaner case, the bulging part is so formed as to be connected to mutually opposed ones of the inner walls, and wherein the resonator comprises a structure in which a compartment continuously surrounded by the bulging part and the inner walls is closed with a lid provided with a communication hole.

2. The air cleaner device according to claim 1, wherein a plurality of the bulging parts are provided, and wherein a part of the bulging parts is so formed as to be connected to the inner wall and the other bulging part which are opposed to each other.

3. The air cleaner device according to claim 2, wherein a vehicle to which the air cleaner device is mounted has a cross member interconnecting a pair of left and right frames in a vehicle width direction, a plurality of the resonators are provided, the plurality of the resonators are juxtaposed along the cross member, one of the plurality of the bulging parts is formed in a direction along the cross member, and the cross member is disposed in an inside space of the recessed surface of the bulging part.

4. The air cleaner device for the internal combustion engine according to claim 3, wherein the plurality of the lids are integrally connected by a connecting part, and the connecting part is fixed to the air cleaner case.

5. The air cleaner device according to claim 2, wherein a throttle body having a throttle valve is connected to the internal combustion engine, a throttle wire configured to control the opening of the throttle valve is connected to the throttle valve, one of the plurality of the bulging parts is formed along a direction in which the throttle wire extends, said device further comprising a plurality of the resonators wherein the plurality of the resonators are juxtaposed along a direction substantially orthogonal to the direction in which the throttle wire extends, and wherein the throttle wire is disposed in an inside space of the recessed surface of the bulging part.

6. The air cleaner device according to claim 1, wherein the lid is mounted on an extension part integrally extended from vicinity of a peak of the projected surface of the bulging part.

7. The air cleaner device according to claim 1, wherein the communication hole of the lid is provided with a hollow cylindrical part, and wherein the hollow cylindrical part extends from a back surface of the lid toward the inside of the resonator.

8. The air cleaner device according to claim 7, further comprising:

an air duct configured to introduce the intake air into the chamber, wherein the air duct is so disposed that its flow path direction is substantially orthogonal to an axial direction of the hollow cylindrical part in side view of the vehicle.

9. The air cleaner device according to claim 8, further comprising:

a plurality of the lids, wherein hollow cylindrical parts of the plurality of the lids are arranged respectively on both outer sides of a downstream end of the air duct, with reference to the flow path direction of the air duct.

10. An air cleaner device for an internal combustion engine, said air cleaner device comprising:

cleaning filter means for cleaning intake air supplied to the internal combustion engine;

resonator means for reducing intake noise due to the intake air; and air cleaner case means formed therein with a chamber, the cleaning filter means and the resonator means being disposed in the chamber, wherein the chamber is defined by inner walls of the air cleaner case means, wherein at least one of the inner walls is provided with a bulging part roughly U-shaped in section, the bulging part having a projected surface on the inside of the air cleaner case means and a recessed surface on the outside of the air cleaner case means, the bulging part is so formed as to be connected to mutually opposed ones of the inner walls, and wherein the resonator means comprises a structure in which a compartment continuously surrounded by the bulging part and the inner walls is closed with a lid provided with a communication hole.

11. The air cleaner device according to claim 10, wherein a plurality of the bulging parts are provided, and wherein a part of the bulging parts is so formed as to be connected to the inner wall and the other bulging part which are opposed to each other.

12. The air cleaner device according to claim 11, wherein a vehicle to which the air cleaner device is mounted has a cross member interconnecting a pair of left and right frames in a vehicle width direction, the resonator means comprises a plurality of resonators, the plurality of the resonators are juxtaposed along the cross member, one of the plurality of the bulging parts is formed in a direction along the cross member, and the cross member is disposed in an inside space of the recessed surface of the bulging part.

13. The air cleaner device for the internal combustion engine according to claim 12, wherein the plurality of the lids are integrally connected by a connecting part, and the connecting part is fixed to the air cleaner case means.

14. The air cleaner device according to claim 11, wherein a throttle body means having throttle valve means for throttling is connected to the internal combustion engine, throttle wire means for controlling the opening of the throttle valve means is connected to the throttle valve means, one of the plurality of the bulging parts is formed along a direction in which the throttle wire means extends, the resonator means comprising a plurality of resonators wherein the plurality of the resonators are juxtaposed along a direction substantially orthogonal to the direction in which the throttle wire means extends, and wherein the throttle wire means is disposed in an inside space of the recessed surface of the bulging part.

15. The air cleaner device according to claim 10, wherein the lid is mounted on an extension part integrally extended from vicinity of a peak of the projected surface of the bulging part.

16. The air cleaner device according to claim 10, wherein the communication hole of the lid is provided with a hollow cylindrical part, and wherein the hollow cylindrical part extends from a back surface of the lid toward the inside of the resonator means.

17. The air cleaner device according to claim 16, further comprising:

air duct means for introducing the intake air into the chamber, wherein the air duct means is so disposed that its flow path direction is substantially orthogonal to an axial direction of the hollow cylindrical part in side view of the vehicle.

18. The air cleaner device according to claim 17, further comprising:

a plurality of the lids, wherein hollow cylindrical parts of the plurality of the lids are arranged respectively on both outer sides of a downstream end of the air duct means, with reference to the flow path direction of the air duct means.

* * * * *